US008453407B2

(12) United States Patent
Tedesco et al.

(10) Patent No.: US 8,453,407 B2
(45) Date of Patent: Jun. 4, 2013

(54) SEISMIC CLIP

(75) Inventors: Lee M. Tedesco, Shorewood, IL (US); James J. Lehane, Jr., McHenry, IL (US); Peder J. Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 271 days.

(21) Appl. No.: 12/644,035

(22) Filed: Dec. 22, 2009

(65) Prior Publication Data

US 2011/0146194 A1 Jun. 23, 2011

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04B 1/98*** | (2006.01) |
| ***E04H 9/02*** | (2006.01) |
| ***E04C 2/52*** | (2006.01) |

(52) U.S. Cl.
USPC ..... 52/506.06; 52/506.07; 52/220.6; 52/167.1

(58) Field of Classification Search
USPC ..... 52/506.06, 506.07, 665, 167.1, 220.6, 52/506.01
See application file for complete search history.

(56) References Cited

U.S. PATENT DOCUMENTS

| | | | | |
|---|---|---|---|---|
| 3,565,474 | A | 2/1971 | Stumbo et al. | |
| 3,798,865 | A * | 3/1974 | Curtis | 52/665 |
| D248,013 | S | 5/1978 | Win | |
| 4,462,198 | A | 7/1984 | Sharp | |
| 4,479,341 | A * | 10/1984 | Schuplin | 52/665 |
| 4,715,161 | A * | 12/1987 | Carraro et al. | 52/714 |
| 4,893,961 | A * | 1/1990 | O'Sullivan et al. | 403/232.1 |
| 4,989,387 | A | 2/1991 | Vukmanic et al. | |
| 5,046,294 | A * | 9/1991 | Platt | 52/506.06 |
| 5,195,289 | A * | 3/1993 | LaLonde et al. | 52/506.06 |
| 5,201,787 | A | 4/1993 | LaLonde et al. | |
| 6,205,732 | B1 | 3/2001 | Rebman | |
| 6,305,139 | B1 | 10/2001 | Sauer | |
| 7,293,393 | B2 * | 11/2007 | Kelly et al. | 52/665 |
| 7,552,567 | B2 * | 6/2009 | Ingratta et al. | 52/506.07 |
| 7,614,195 | B2 * | 11/2009 | Platt et al. | 52/506.06 |

(Continued)

FOREIGN PATENT DOCUMENTS

EP 0 516 330 A2 12/1992

OTHER PUBLICATIONS

U.S. Appl. No. 29/299,675, filed Jan. 1, 2008, Inventor: James J. Lehane, Title: Perimeter Clip for Ceiling Grid Systems.

(Continued)

*Primary Examiner* — Andrew Triggs
(74) *Attorney, Agent, or Firm* — Pearne & Gordon LLP

(57) ABSTRACT

A seismic clip for suspended ceiling grid tees that offers high strength, rigidity, versatility and ease of assembly while improving the ability of a clip to self-align with a grid tee. The clip includes a lanced tab that serves to establish and maintain alignment of the clip body and the tee to which it is assembled whereby a tendency of a clip to be tilted upwardly relative to the tee is eliminated or greatly reduced. The alignment tab serves to initially align the clip and tee either when it is assembled by snapping it over the tee or by sliding the tee endwise into the clip. The tab is configured so that it does not unduly add to the assembly force level when the clip is snapped over the tee or when the tee and clip are slipped endwise together.

4 Claims, 2 Drawing Sheets

U.S. PATENT DOCUMENTS

| | | | | |
|---|---|---|---|---|
| D612,224 | S * | 3/2010 | Wendt | D8/354 |
| 7,673,429 | B2 * | 3/2010 | Frecska | 52/506.07 |
| 7,690,168 | B2 * | 4/2010 | LaLonde | 52/506.08 |
| 7,788,875 | B2 * | 9/2010 | Wendt | 52/712 |
| 7,874,116 | B2 * | 1/2011 | LaLonde | 52/506.08 |
| 7,930,864 | B2 * | 4/2011 | Wendt | 52/712 |
| 8,046,966 | B2 * | 11/2011 | Moore et al. | 52/506.06 |
| 2005/0086888 | A1 * | 4/2005 | Moore et al. | 52/506.06 |
| 2005/0160696 | A1 * | 7/2005 | Kelly et al. | 52/712 |
| 2006/0096219 | A1 * | 5/2006 | Ingratta et al. | 52/506.07 |
| 2007/0180787 | A1 * | 8/2007 | Fecska | 52/506.06 |
| 2008/0060306 | A1 * | 3/2008 | Platt et al. | 52/506.06 |
| 2011/0146194 | A1 * | 6/2011 | Tedesco et al. | 52/665 |

OTHER PUBLICATIONS

USG Interiors, Inc., Ceiling Systems, Marketing Catalog, Publication No. SC2392, Aug. 2002, p. 229.

Written Opinion of the International Searching Authority & International Search Report dated Mar. 23, 2011 for corresponding PCT/US2010/061225, filed Dec. 20, 2010.

* cited by examiner

SEISMIC CLIP

The invention relates to accessories for suspended ceiling grid construction and, in particular, to a seismic clip for stabilizing the grid members.

PRIOR ART

U.S. Pat. Nos. 5,046,294; 7,293,393; and 7,552,567 are examples of seismic clips used to limit movement of the ends of grid tee members at the perimeter of a suspended ceiling grid. There remains a need for an improved seismic clip that, while being economical, is both versatile and easy in installation and rugged in its construction. In particular, the clip should be capable of being both snapped over a grid tee and slipped onto the grid tee end to satisfy the installer's preference or need. The installation of an individual clip should not require a high assembly force or complicated manipulation since a typical job will require the assembly of a clip and tee to be repeated numerous times.

SUMMARY OF THE INVENTION

The invention provides a seismic clip for suspended ceiling grid tees that offers high strength, rigidity, versatility and ease of assembly while improving the ability of a clip to self-align with a grid tee. The disclosed clip includes a lanced tab that serves to establish and maintain alignment of the clip body and the tee to which it is assembled. More specifically, a tendency of a clip to be tilted upwardly relative to the tee is eliminated or greatly reduced. As a related added benefit, the alignment tab serves to initially align the clip and tee either when it is assembled by snapping it over the tee or by sliding the tee endwise into the clip. The tab is configured so that it does not unduly add to the assembly force level when the clip is snapped over the tee or when the tee and clip are slipped endwise together.

DESCRIPTION OF THE PREFERRED EMBODIMENT

Figure 1:
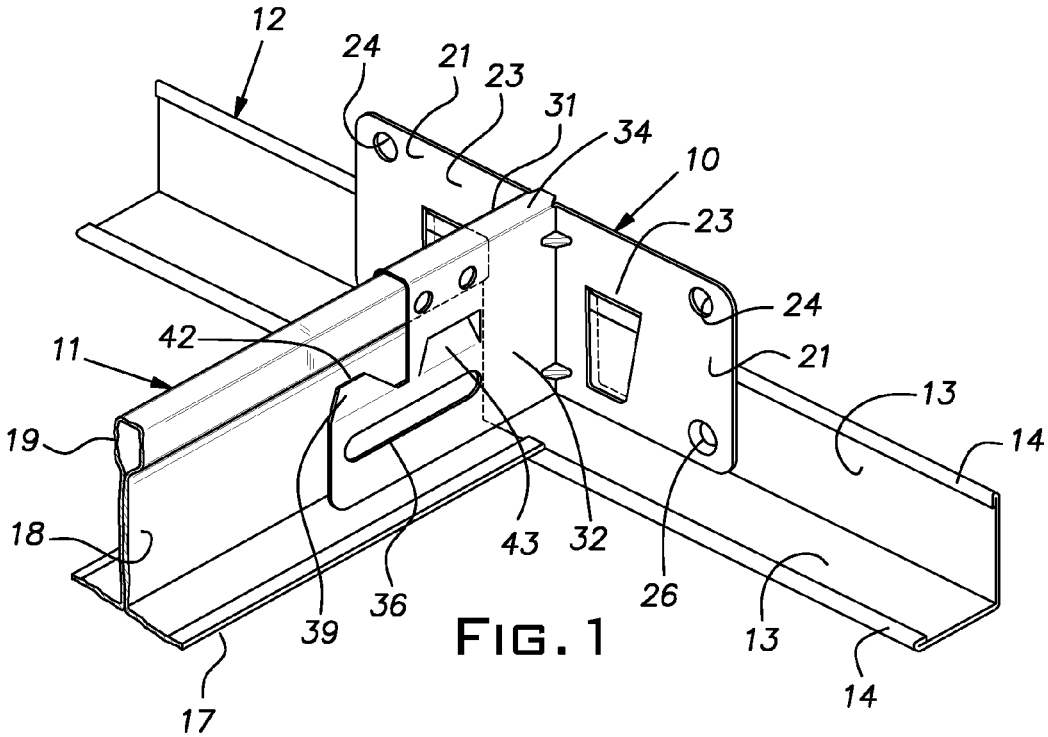
FIG. 1 is a perspective view of the seismic clip of the invention installed on the end of a grid tee and a wall angle.
Figure 2:
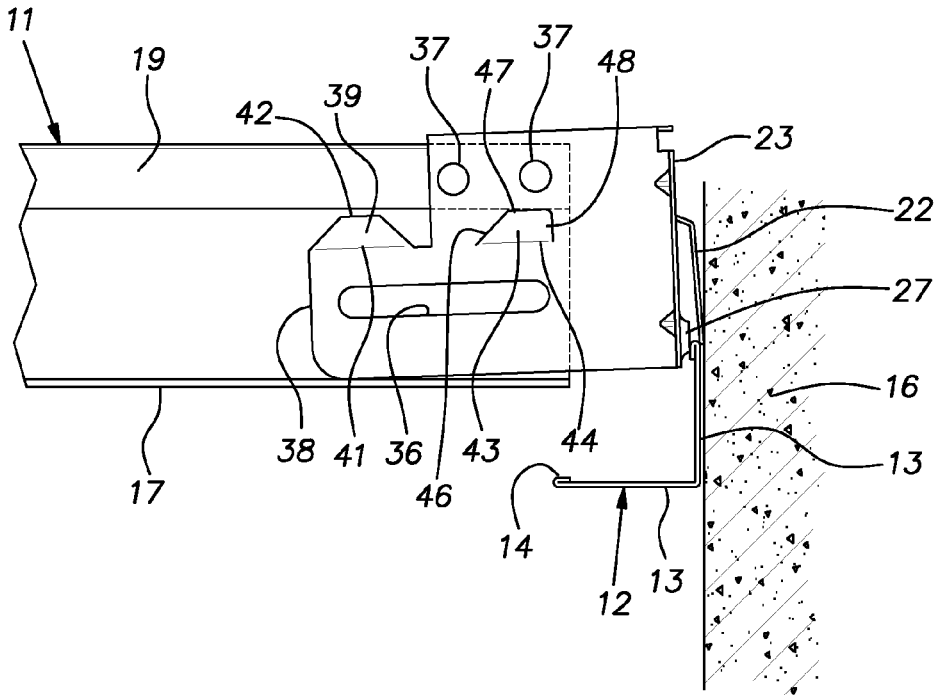
FIG. 2 is a side elevational view of the seismic clip, grid tee and wall angle assembly.

Referring now to the drawings, a seismic clip is used to tie or anchor a grid tee 11 to a wall angle 12. The illustrated wall angle 12 is of a conventional construction being roll-formed sheet metal typically 10' or 12' long (or metric equivalent) and having perpendicular legs 13 of, normally, ⅞" (or metric equivalent) width. The free edges of the legs 13 are folded back to form stiffening hems 14. As is conventional, a vertical leg 13 of the wall angle 12 is attached to a wall 16 with screws, nails, staples, or the like at ceiling level.

The illustrated grid tee 11 can be a main tee or a cross tee, these terms being commonly understood in the industry. Relatively long main tees are assembled with shorter cross tees to make up a suspended grid for supporting rectangular ceiling panels. A conventional tee 11 has a lower flange 17, a vertical stem or web 18, and an upper reinforcing or stiffening hollow bulb 19 usually rectangular in form and nominally ¼" (or metric equivalent) in width.

The seismic clip 10 is preferably a unitary stamping made of suitable metal such as 0.028" hot dipped galvanized (H.D.G.) sheet steel. The geometry of the seismic clip 10 is described with reference to its installed orientation.

Figure 3:
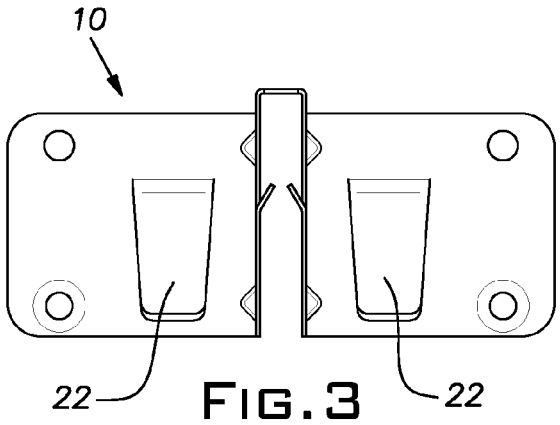
FIG. 3 is a front elevational view of the seismic clip.
Figure 4:
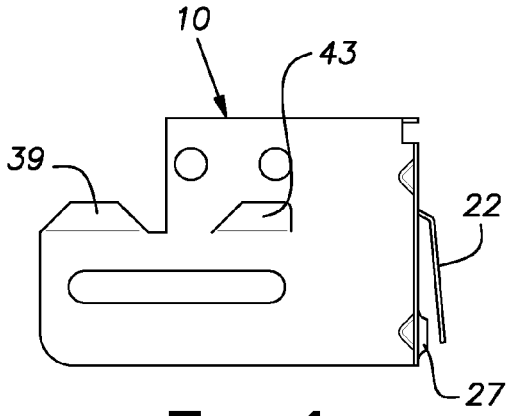
FIG. 4 is a right side elevational view of the seismic clip.
Figure 5:
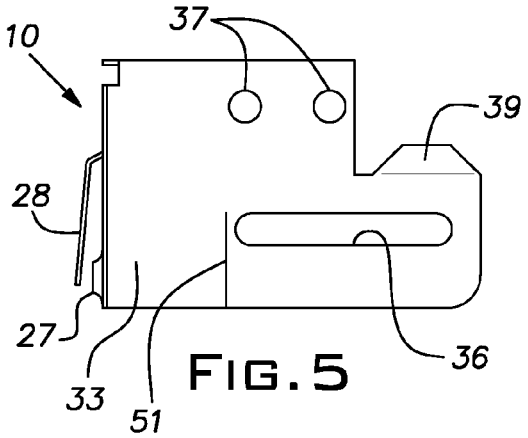
FIG. 5 is a left side elevational view of the seismic clip.
Figure 6:
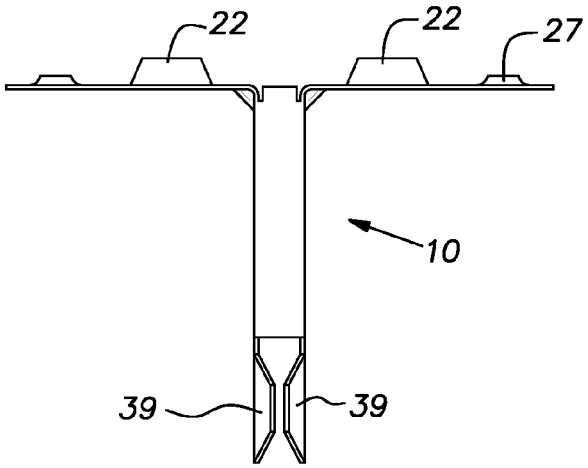
FIG. 6 is a top view of the seismic clip.

In plan view, shown in FIG. 6, the clip 10 has a generally T-shaped configuration. The clip 10 is essentially symmetrical about a central vertical plane that when installed on a tee 11, coincides with the plane of the web 18 of the tee. The clip 10 includes a pair of coplanar wings 21 that are perpendicular to and extend in opposite directions away from the central plane of symmetry. In an elevational view, shown in FIG. 3, the wings 21 are generally rectangular. Tabs 22 that serve as hooks are lanced or stamped from the central areas of the wings 21. The tabs 22 remain connected to the wings 21 at their upper regions 23 and lie in generally vertical planes, but preferably diverging from the plane of the wings at about 5 degrees, spaced slightly behind the plane of the wings. At the distal upper corners of the wings 21 are holes 24 for receiving screws or nails to fasten the clip 10 to a wall 16. At the distal lower corners of the wings are similar holes 26 and, optionally concentric small circular embossments or standoffs that assist in keeping the clip in alignment with the planes of the wall 16 and ceiling by accounting for the thickness of the hems 14.

A central section or saddle 31 of the clip 10, forming the stem section of the T-shape of the clip seen in plan view, is proportioned to fit over the bulb 19 and web 18 of the end of a grid tee 11. The saddle 31 is a double wall structure; the walls, designated 32, 33, are in parallel vertical planes. The walls 32, 33 are spaced apart by an upper web 34. The web 34 is preferably dimensioned to closely fit the walls 32, 33 on the sides of the grid tee bulb 19.

Below their bulb engaging areas, the saddle walls 32, 33 are arranged to be spaced from the web 18 of the grid tee 11. An elongated horizontal slot or opening 36 is formed in each saddle wall 32, 33 so that the slots oppose one another. Above the slot 36 on each wall 32, 33 are a pair of holes 37. Adjacent a forward end or edge 38 of each wall, a tab 39 of trapezoidal shape is bent inwardly from a line or base 41 of attachment with the main body of the respective wall. In its free state, each tab 39 has an upper free or distal horizontal edge 42 configured, when assembled with a tee to extend beneath the bulb 19 and be spaced slightly from the tee web 18.

On the right saddle wall 32 there is stamped or lanced a tab 43. The tab 43 is angled inward and upward from a line or base 44 of attachment with the wall proper. The tab profile is that of a polygon with a forward edge 46 that angles rearwardly and upwardly from its base 44, an upper horizontal free edge 47, and a rearward edge 48 perpendicular to its base. Ideally, the tab 43 is similar to the leading tab 39 such that these tabs lie in a common plane and their respective bases 41, 44 and upper edges 42, 47 lie along common lines.

The clip 10 can, at the option of the installer, be assembled on the end of a grid tee 11 by either snapping it over the top of the bulb 19 or by sliding the tee and clip relative to one another in the longitudinal direction of the tee. A line 51 is embossed in the left saddle wall 33 to mark a distance of ¾" from the plane of the wings 21 to be used as a gauge for the installer where a building code requires the grid tee to be installed not closer than this dimension from the vertical leg 13 of the wall angle 12. The clip 10 is assembled on a wall angle by lowering it onto the vertical leg 13 with the hooks or tabs 22 behind the leg and the main clip body in front of the leg. This can be done before or after the clip is assembled with the tee.

The front or leading tabs 39 on the saddle walls 32, 33 facilitate assembly of the clip onto the tee where the tee is inserted longitudinally into the clip. The leading edges of the tabs 39 guide the grid tee web 18 towards the center of the clip without impeding relative longitudinal motion. The free edges 42 of the tabs 39 are spaced only a limited distance greater than the thickness of the web 18, so that the bulb 19 is roughly centered before the bulb engages the saddle 31.

Figure 7:
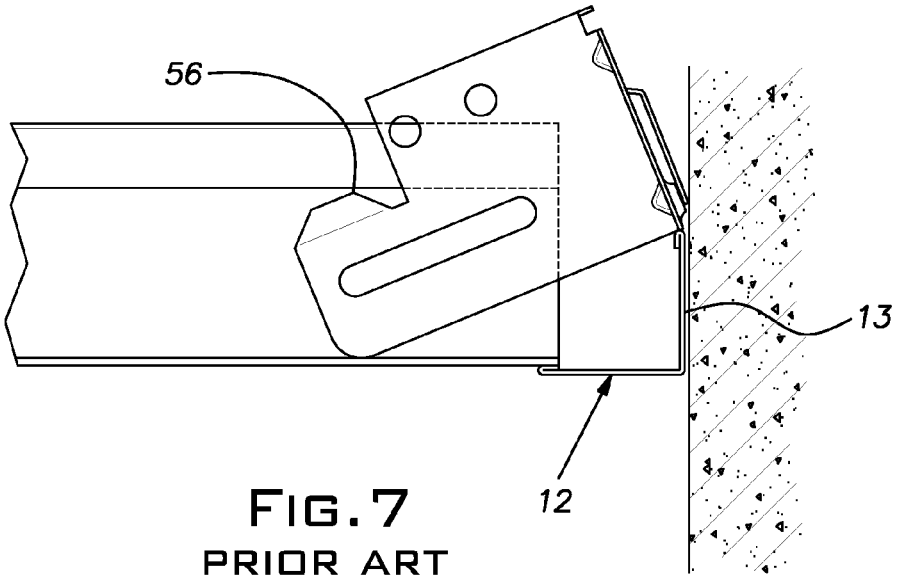
FIG. 7 PRIOR ART
FIG. 7 is a side view of the prior art.

The lanced tab 43 serves to align the tee 11 and clip 10 so that the clip is restrained from tilting excessively upwardly. This is accomplished by the lanced tab 43 engaging the underside of the reinforcing bulb 19 with its upper edge 47. The lanced tab 43 can be proportioned to allow some tilt between the clip 10 and tee 11 for ease of assembly and compatibility with various sized reinforcing bulbs. Such tilting is restricted so that where the clip 10 is positioned on the end of the grid tee 11 prior to positioning of the clip onto the wall angle 12, the tilt is not severe enough to prevent the tabs or hooks 22 from contacting the wall and slipping behind the wall angle 12. Reference is made to FIG. 7 where a prior art clip is seen to be free to tilt on a grid tee, pivoting about a point 56 of a tab. It will be seen in this figure that the lower edges of the clip wings can strike the upper edge of a wall angle 12 and prevent the hooks of such prior art design from slipping behind the vertical leg 13 of the wall angle 12. The lanced tab 43 of the present invention can prevent this excessive tilting of the clip 10 thereby facilitating rapid assembly of the clip to the wall angle. Moreover, under seismic conditions, when a cross tee slips outwardly off the wall angle and gravity pulls down on the cross tee to prior art clip assembly, some damage may occur with loosening of the friction fit of the clip to the wall angle and tilting of the clip may occur. With the prior art clip under severe conditions excessive tilting may occur (similar to the showing in FIG. 7) and contribute to tile fall out. The lanced tab 43 of the invention wedges the bulb 19 between the lower side of the saddle 31 and the upper edge 47 of the tab 43 thus preventing this excessive tilting.

The clip 10 can be secured to the wall 16 after it is properly located on the wall angle with screws or nails in some or all of the wing holes 24, 26. Depending on the applicable building code, self-drilling screws can be driven into the reinforcing bulb 19 through the holes 37 that abut the sides of the bulb 19 to lock the clip 10 and tee 11 against relative movement. In other cases where limited movement between the clip 10 and tee 11 is desired, a self-drilling screw can be located at the center of the slot 36 and driven into the tee web 18.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A seismic clip for anchoring the end of a suspended ceiling grid member to a wall angle comprising a unitary sheet metal stamping, the clip having a central saddle section and a pair of mounting wings extending in opposite directions from a rear of the saddle section, the saddle section having a pair of spaced parallel generally planar walls, the walls and wings being symmetrical about an imaginary plane midway between the walls, the wings lying in a common plane perpendicular to the imaginary plane and each including a hook behind said plane for gripping a vertical leg of the wall angle, the saddle walls each having a top joined by an intermediate web from which the saddle walls vertically depend, the saddle walls being connected only at their tops such that an opening exists between the wings, the web spacing the saddle walls a distance whereby the saddle walls are adapted to straddle and snap over the top of an upper reinforcing bulb of the grid member to assemble the clip on the end of the grid member, the saddle walls having a pair of opposed tabs adjacent their forward ends adapted to engage the underside of the reinforcing bulb when the clip is installed on the grid member, the saddle walls including holes for receiving a screw to be driven into the reinforcing bulb of the grid member and elongated slots for a screw to be driven into a web of the grid member, a lanced tab in one of the saddle walls spaced to the rear from the opposed tab of its wall, the lanced tab being arranged to restrain the clip, when installed on the end of the grid member, from tilting excessively upwardly where, under seismic conditions the grid member slips in the saddle section outwardly off the wall angle and gravity pulls down on the grid member to clip assembly.

2. A seismic clip as set forth in claim 1, wherein said lanced tab has an upper edge at an elevation equal to an elevation of an upper edge of the adjacent opposed tab.

3. A seismic clip as set forth in claim 1, wherein the lanced tab is spaced from the plane of the wings by a distance of about ¾ inch.

4. A seismic clip for anchoring the end of a suspended ceiling grid member to a wall angle comprising a unitary sheet metal stamping, the clip having a central saddle section and a pair of mounting wings extending in opposite directions from a rear of the saddle section, the saddle section having a pair of spaced parallel generally planar walls, the walls and wings being symmetrical about an imaginary plane midway between the walls, the wings lying in a common plane perpendicular to the imaginary plane and each including a hook behind said plane for gripping a vertical leg of the wall angle, the walls each having a top joined to an intermediate web and depending vertically from the intermediate web that spaces the walls a distance whereby the walls are adapted to straddle and snap over the top of an upper reinforcing bulb of the grid member to assemble the clip on the end of the grid member, the walls being connected only at their tops such that an opening exists between the wings, the walls having a pair of opposed tabs adjacent their forward ends adapted to engage the underside of the reinforcing bulb when the clip is installed on the grid member, the walls including holes for receiving a screw to be driven into the reinforcing bulb of the grid member and elongated slots for a screw to be driven into a web of the grid member, a lanced tab in one of the saddle walls spaced to the rear from the opposed tab of its wall, the lanced tab being arranged to restrain the clip, when installed on the end of the grid member, from tilting upwardly to a degree where the hooks are obstructed from engaging an upper edge of a vertical leg of the wall angle by adjacent areas of the wings thereby preventing the hooks from being inserted between the wall angle and a building wall to which the wall angle is attached.

* * * * *